US006122875A

United States Patent [19]

Schiedegger et al.

[11] Patent Number: 6,122,875

[45] **Date of Patent: *Sep. 26, 2000**

[54] CUSTOM LENGTH SHUTTER ASSEMBLY

[75] Inventors: Charles E. Schiedegger, Metamora; Nicholas Gerald Ward, Fort Gratiot; Clyde George Allen, North Branch, all of Mich.

[73] Assignee: Tapco International Corporation, Plymouth, Mich.

[ * ] Notice: This patent is subject to a terminal disclaimer.

[21] Appl. No.: 09/295,123

[22] Filed: Apr. 20, 1999

Related U.S. Application Data

[63] Continuation of application No. 09/023,145, Feb. 12, 1998, Pat. No. 5,946,873, which is a continuation of application No. 08/697,817, Aug. 30, 1996, Pat. No. 5,761,865.

[51] Int. Cl.[7] ..... E06B 9/00

[52] U.S. Cl. ..... 52/457; 52/455; 52/458; 52/745.19

[58] Field of Search ..... 52/473, 455, 456, 52/457, 458, 800.1, 800.12, 800.13, 314, 316, 475.1, 745.19

[56] References Cited

U.S. PATENT DOCUMENTS

| | | |
|---|---|---|
| 964,676 | 7/1910 | Nellis . |
| 1,247,287 | 11/1917 | Lachman . |

(List continued on next page.)

FOREIGN PATENT DOCUMENTS

| | | |
|---|---|---|
| 3439782 | 10/1984 | Germany . |
| 683631 | 4/1994 | Switzerland . |
| 2055940 | 3/1981 | United Kingdom . |

OTHER PUBLICATIONS

Drawing of "Biased Raised Panel Cap", 1998.
Shutters, Inc., "Tool requirements for producing new (patented) raised panel shutter", Jun. 5, 1992.
Shutters, Inc., "A ten foot raised panel shutter? Of course . . . and only from Shutters, Inc.".
Shutters, Inc., Invoice from Shutters, Inc. to Pries Supply Company, Jul. 10, 1992.
Shutters, Inc., Invoice from Heinz Plastic Mold Company to Shutters, Inc., Feb. 11, 1992.
Shutters, Inc., Invoice from Shutters, Inc. to Custom Shutters, Jul. 11, 1991.
Shutters, Inc., "A ten foot raised panel shutter? Of course . . . and only from Shutters, Inc" (with modifications).
Shutters, Inc., Invoice from Heinz Plastic Mold Company to Shutters, Inc., Jan. 9, 1992.

(List continued on next page.)

*Primary Examiner*—Laura A. Callo
*Attorney, Agent, or Firm*—Howard & Howard

[57] ABSTRACT

A component shutter assembly and method of forming same. The assembly comprises a one-piece molded plastic, integrally formed shutter panel. The shutter panel may be molded in a small plurality of standard lengths and then one or both ends thereof cut to shorten the shutter panel to a specific, desired length once it is determined what-specific length of shutter is needed for a particular application. An independent, integrally formed end panel may then be secured to one or both ends of the cut shutter panel and ultrasonically welded thereto to form a finished component shutter assembly having a particular desired length and the appearance of a one-piece, integrally formed shutter. Embodiments directed to raised panel and louvered shutters are disclosed, as is a removable center panel section which may be used in connection with the louvered shutter panels if it is desired to provide a mid-panel section which is offset from the mid-point of the overall length of the shutter panel. By providing standard length shutter panels which may be cut to specific desired lengths, component shutter assemblies can be created which have a wide plurality of overall lengths from only a very small plurality of standard length panels. The assembly of each of the component shutter assemblies disclosed is also simplified considerably as a much smaller plurality of independent component parts are required to be assembled to form a finished component shutter assembly.

2 Claims, 3 Drawing Sheets

U.S. PATENT DOCUMENTS

| | | | |
|---|---|---|---|
| 2,596,569 | 5/1952 | Leigh . | |
| 3,055,467 | 9/1962 | Peek et al. . | |
| 3,172,540 | 3/1965 | Berge . | |
| 3,191,242 | 6/1965 | Rauen . | |
| 3,364,643 | 1/1968 | Smith et al. . | |
| 3,455,079 | 7/1969 | Frederick . | |
| 3,548,555 | 12/1970 | Trostle et al. . | |
| 3,797,186 | 3/1974 | Smith . | |
| 4,023,320 | 5/1977 | Jackson . | |
| 4,090,799 | 5/1978 | Crotti et al. . | |
| 4,251,966 | 2/1981 | Foltman . | |
| 4,381,633 | 5/1983 | MacLeod . | |
| 4,765,110 | 8/1988 | MacLeod . | |
| 4,858,400 | 8/1989 | Foyt . | |
| 4,875,318 | 10/1989 | MacLeod et al. . | |
| 4,915,758 | 4/1990 | Baggett, Jr. et al. . | |
| 5,060,442 | 10/1991 | Chubb . | |
| 5,152,116 | 10/1992 | MacGowan . | |
| 5,163,260 | 11/1992 | Ricard et al. . | |
| 5,265,391 | 11/1993 | Ricard et al. . | |
| 5,347,782 | 9/1994 | Vagedes . | |
| 5,349,799 | 9/1994 | Schiedegger et al. . | |
| 5,459,972 | 10/1995 | Eckel . | |
| 5,524,407 | 6/1996 | Ricard et al. . | |
| 5,526,857 | 6/1996 | Forman . | |
| 5,617,688 | 4/1997 | Gandy et al. . | |
| 5,704,182 | 1/1998 | Schiedegger . | |
| 5,761,865 | 6/1998 | Schiedegger et al. . | |
| 5,782,052 | 7/1998 | Lacy | 52/473 |
| 5,946,873 | 9/1999 | Schiedegger et al. | 52/457 |

OTHER PUBLICATIONS

Shutters, Inc., Invoice from Shutters, Inc. to Pries Supply Co., Sep. 21, 1993.
Shutters, Inc., "Lineal Shutter Component Supply Price List", 1995.
Shutters, Inc., "Lineal shutter Component Supply Price List", 1993.
"Front View of 'Raised Panel Cap'", 1998.
"Top View of 'Raised Panel Cap'", 1998.
Shutters, Inc., "All–size shutters", 1992.
Shutters, Inc., "Ideabook—All–Size Shutters From Shutters, Inc.", 1997.
Shutters, Inc., check request for Heinz Plastic Mold Co., Jan. 19, 1993.
Shutters, Inc., check from Shutters, Inc. to Heinz Plastic Mold Co., Sep. 30, 1992.
Shutters, Inc., Invoice from Heinz Plastic Mold Company to Shutters, Inc., Sep. 30, 1992.
Shutters, Inc., Shipping ticket/debit memo form from Shutters, Inc. to Heinz Plastic Mold Co., Sep. 25, 1992.
Shutters, Inc., Shipping receipt from Shutters, Inc. to Heinz Plastic Mold Company, Sep. 25, 1992.
Shutters, Inc., Packing list from Heinz Plastic Mold Company to Shutters, Inc., Oct. 1, 1992.
Shutters, Inc., "National Sales Meeting—Jan. 24, 1991—The Year of the Lineal", 1991.
Shutters, Inc., videotape of Shutters, Inc.'s products, Nov., 1998.
Deposition Transcript of Michael J. Ricard, Nov. 23, 1998.

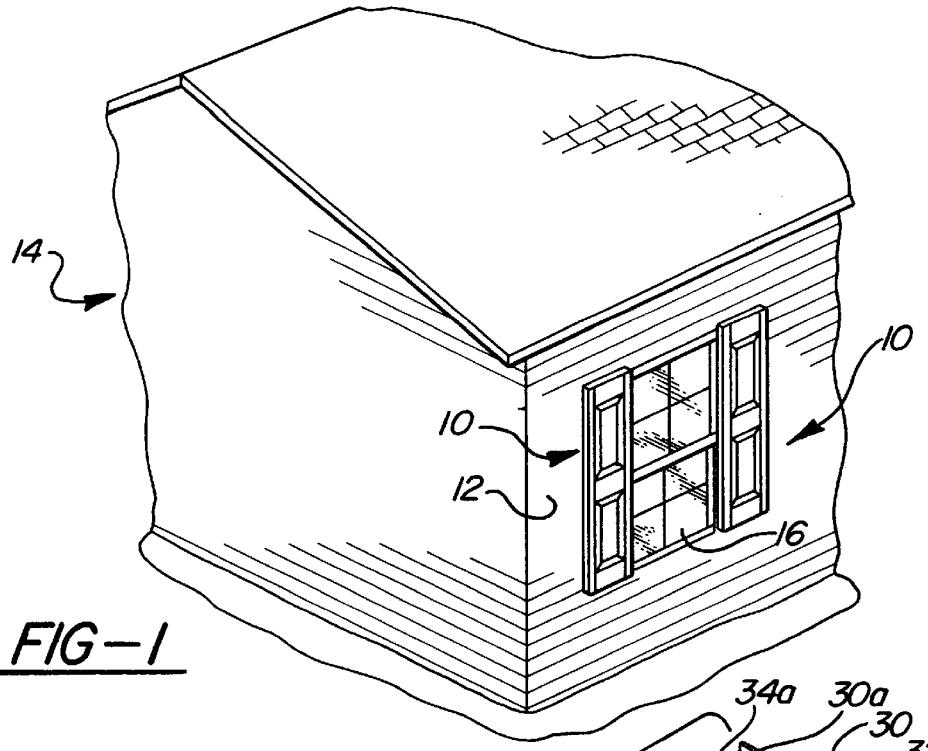
FIG-1
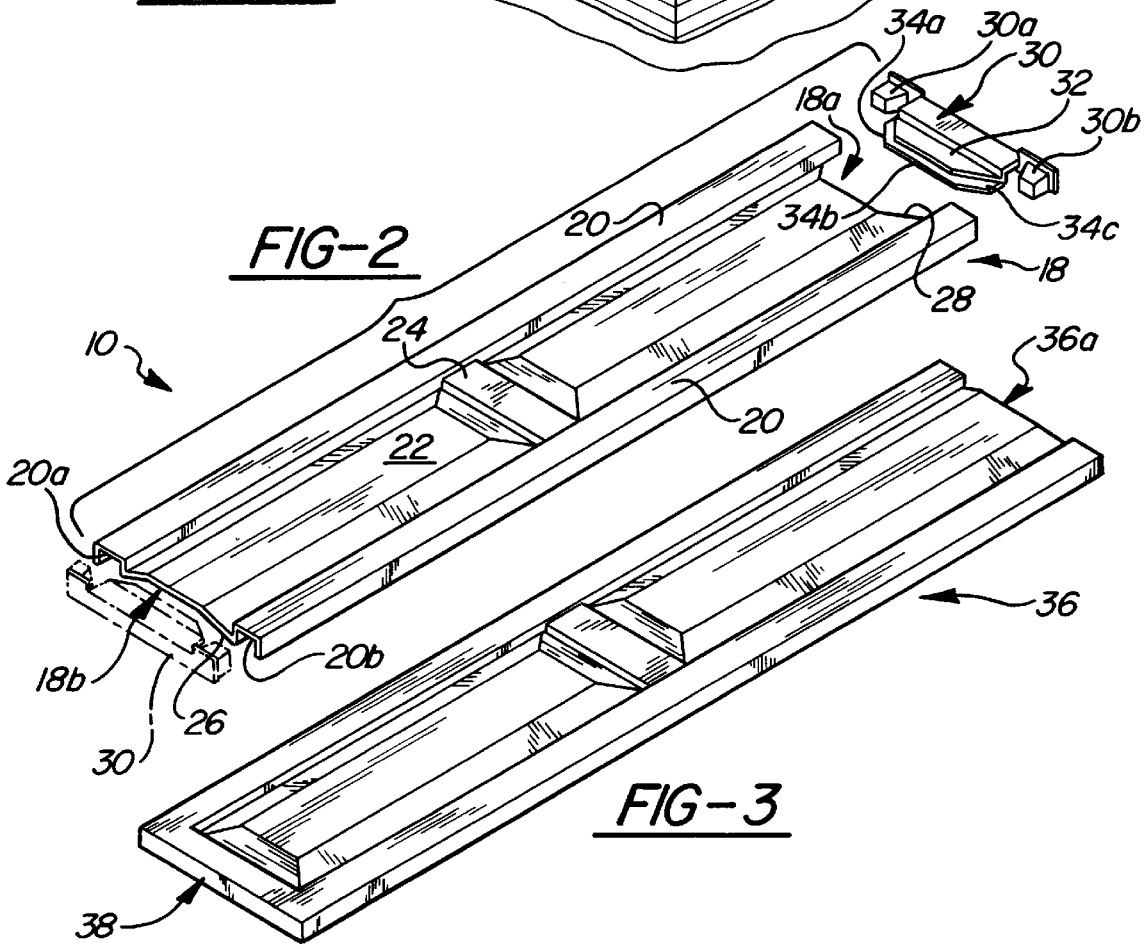
FIG-2
FIG-3

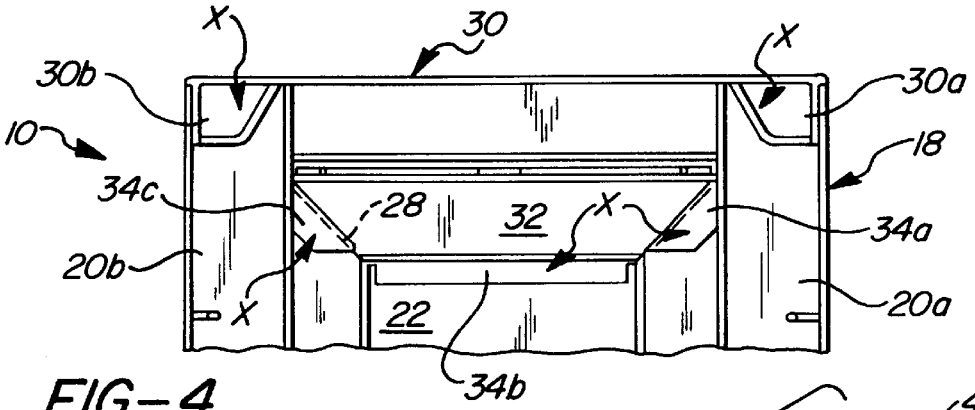
FIG-4
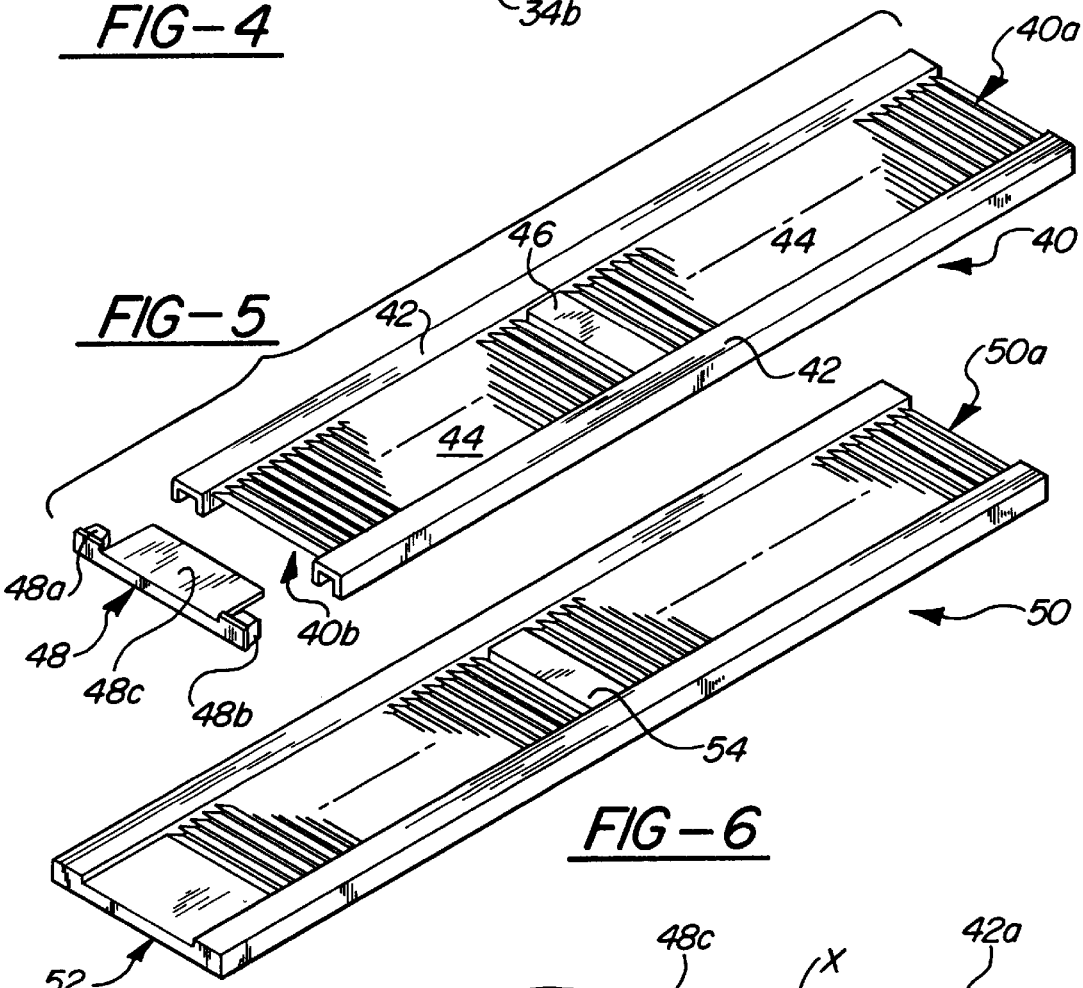
FIG-5
FIG-6
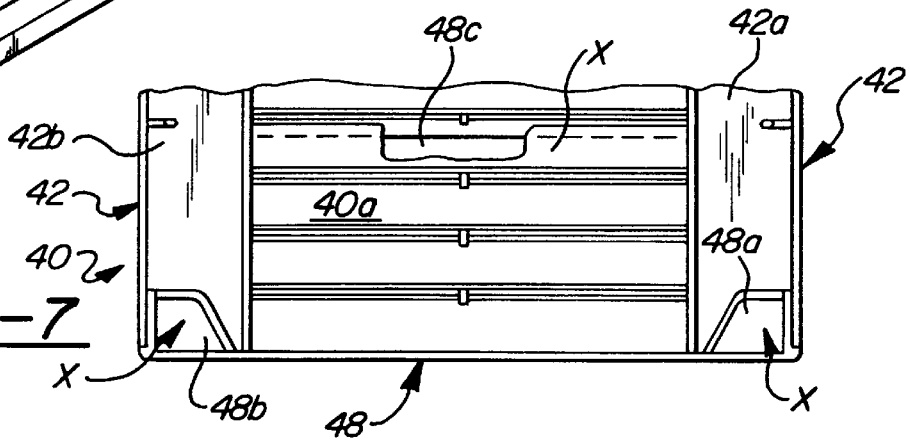
FIG-7

CUSTOM LENGTH SHUTTER ASSEMBLY

This application is a continuation of U.S. Ser. No. 09/023,145 filed on Feb. 12, 1998, now U.S. Pat. No. 5,946,873, which is a continuation of U.S. Ser. No. 08/697,817 filed on Aug. 30, 1996, now U.S. Pat. No. 5,761,865.

BACKGROUND OF THE INVENTION

1. Technical Field

This invention relates to decorative shutter panels adapted to be placed on an exterior surface of a structure such as a residential or commercial dwelling. More particularly, the invention relates to a component shutter assembly and a method for forming the shutter assembly such that the assembly has a custom desired length as dictated by the specific structure to which the shutter assembly is to be secured.

2. Discussion

Decorative shutter assemblies are used in a wide variety of applications to provide an aesthetically pleasing appearance to exterior walls of a building such as a residential or a commercial dwelling. Typically such shutter assemblies are placed on opposite sides of windows of the dwelling. Since the specific heights of windows suitable for use in residential and commercial dwellings can vary considerably, it has been heretofore necessary for a manufacturer of such decorative shutter assemblies to carry a relatively large plurality of different length shutter assemblies or, alternatively, to manufacture a component shutter assembly which can be assembled "on-site" by an installer, or to perform a custom assembly for each specific length of shutter ordered.

All of the above-described arrangements have drawbacks. For one a manufacturer producing one-piece molded shutters would be required to have tooling suitable to manufacture shutters having any one of a large plurality of desired lengths. Accordingly, a very large investment in mold tooling would be necessary to be able to manufacture shutters having widely varying lengths.

Providing component shutter assemblies does not require quite the large number of mold toolings as described above, but nevertheless typically requires mold tooling for forming a pair of side rails, one or more center panel sections and one or more end panel sections. Additionally, there is the cost of labor involved in assembling the shutter into a one-piece component. This assembly, in some instances, is also not performed quite as easily "on-site" by installers.

Accordingly, there exists a need for a component shutter assembly which is relatively inexpensive to manufacture and can be constructed to a wide variety of specific lengths without detailed assembly procedures necessary with prior developed component shutter assemblies. More specifically, there is a need for a component shutter assembly which may be manufactured from only a very small number of molding tools, to thereby significantly reduce the cost of manufacture, and which further can be assembled even more quickly than previously developed component shutter assemblies.

SUMMARY OF THE INVENTION

The above needs are met by a component shutter assembly and a method of forming same to a wide variety of lengths to, in effect, allow custom-length shutter assemblies to be formed from only a very limited number of injection mold tools.

The shutter assembly of the present invention includes a one-piece shutter panel which is molded from a relatively high strength plastic such as polystyrene or polypropylene. The shutter panel includes a pair of U-shaped, elongated side rails spaced apart from one another by an integrally formed center panel disposed inbetween the side rails. In one preferred embodiment the shutter panel is formed in a small plurality of different lengths, for example, three different lengths of about 40 inches, 60 inches and 80 inches. Once a precise, desired length is determined to be needed for a specific application, the closest length shutter panel which is equal to or larger than the desired length is selected. One end of the selected shutter panel is cut and an independent end panel is fixedly secured to the cut end of the selected shutter panel.

As an example, if the desired length of shutter was 50 inches, than a 60 inch shutter panel would be selected and the excess cut off from one, or possibly both ends, before one or more end panels are secured to the shutter panel. The resulting shutter panel assembly essentially forms a "custom" length component shutter assembly. Only a very limited number of mold tools are required for producing the independent component pieces of the shutter assembly of the present invention, thereby significantly reducing the cost of manufacture without limiting the length of shutters capable of being manufactured.

The method of the present invention involves substantially those steps described above. One of a plurality of pre-determined lengths of shutter panels is selected which is closest in length (without being less) to the desired length of shutter. One end of the shutter is cut to remove the undesired excess length and an independent end panel is fixedly secured to the cut end of the shutter panel. If the opposite end of the shutter panel does not include an integrally formed end panel, then a second independent end panel may be fixedly secured to the opposite end.

In an alternative preferred embodiment one end of the shutter panel includes an integrally molded end panel. With this embodiment the excess length of the shutter is cut completely from the end of the molded end panel of the shutter panel.

In yet another preferred embodiment, a louvered shutter is disclosed. The louvered shutter may be constructed to the desired length by cutting a portion off of each end of the selected shutter and then fixedly securing end panels to each of the just-cut ends. Still further, one end of the louvered shutter panel may be molded with an integrally formed end panel. If so, the entire excess is cut from the end opposite to that having the end panel. An independent end panel is then fixedly secured to the just-cut end. If the louvered shutter panel is not integrally formed with a center panel section, then an independent center panel section is provided which can be fixedly secured by ultrasonic welding at any point along the louvers of the louvered shutter and held thereto without the need for adhesives, ultrasonic welding, threaded screws, etc.

The various embodiments and the methods disclosed herein of the present invention permit shutters having precisely desired lengths to be formed from only a small number of standard lengths. The method of the present invention contemplates providing one-piece, integrally formed shutter panels in a small plurality of different lengths. Once the desired length of shutter is determined, the standard shutter panel which is closest to the length to the desired length (without being shorter than the desired length) is selected and the excess length trimmed from one or both ends of the shutter panel. One or two independent end panels may then be secured to the just-cut shutter panel to form a finished shutter panel having a precisely desired length.

The apparatus and methods of the present invention significantly reduce the number of molding tools required to produce finished shutters having a wide variety of lengths. This, in turn, significantly reduces the overall cost of manufacture of decorative shutter panels. Furthermore, the assembly of the shutter panels disclosed herein is simplified significantly. As a result, the shutter panels can be assembled even more quickly than with complete component shutter assemblies, and easily "on-site" if needed.

BRIEF DESCRIPTION OF THE DRAWINGS

The various advantages of the present invention will become apparent to one skilled in the art by reading the following specification and subjoined claims and by referencing the following drawings in which:

FIG. 1 is a perspective view of a portion of an exterior surface of a building to which the shutter panel of the present invention is secured;

FIG. 2 is an exploded perspective view of a shutter panel in accordance with the present invention and a pair of independent end panels which may be secured to the opposite ends of the shutter after each end has been cut to reduce the shutter in length to a desired length;

FIG. 3 is a view of an alternative preferred embodiment of the present invention showing an elongated, raised panel shutter panel with an integrally formed end panel at one end and at the opposite end of the shutter panel without an end panel to allow the shutter panel to be cut at the opposite end to a desired length;

FIG. 4 is a rear view of the shutter panel and end panel shown in FIG. 2 assembled together, and indicating where ultrasonic welds may be formed to permanently secure the end panel to the shutter panel;

FIG. 5 is an alternative preferred embodiment of the shutter panel incorporating louvers instead of raised panels, and illustrating an independent end panel which may be secured to one end, or both ends, of the shutter panel once the shutter panel has been cut to a desired length;

FIG. 6 is an alternative embodiment of the present invention showing a louvered shutter panel having an integrally formed end panel;

FIG. 7 is a rear view of the louvered shutter panel of FIG. 5 showing the end panel secured to one end of the louvered shutter panel and indicating at which points ultrasonic welds may be placed to fixedly secure the end panel thereto;

DETAILED DESCRIPTION OF THE PREFERRED EMBODIMENTS

Figure 8:
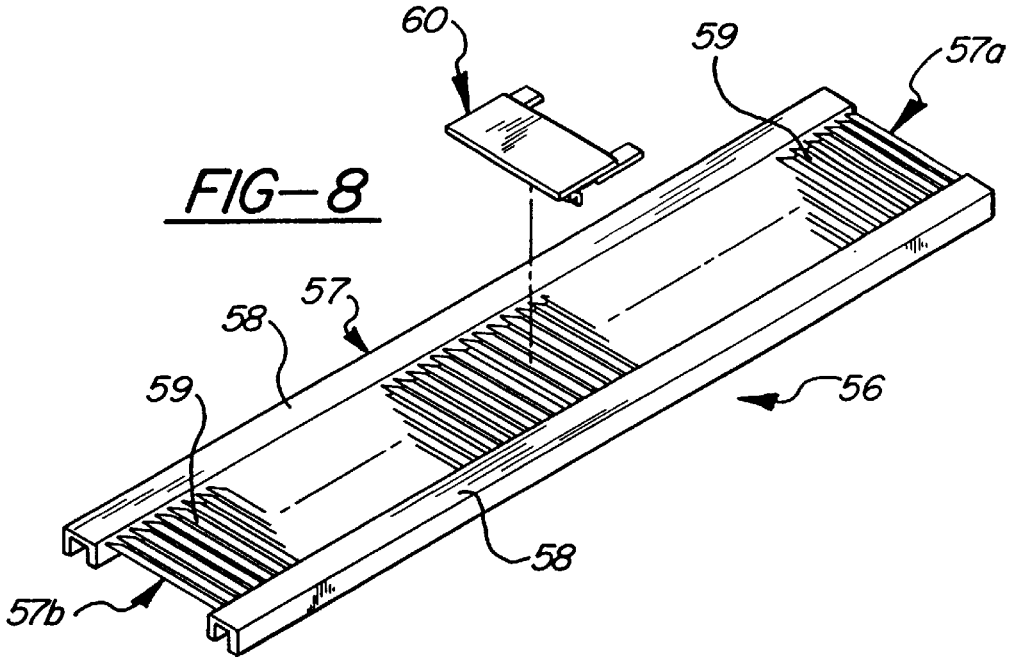
FIG. 8 is an exploded perspective view of a louvered shutter panel incorporating a removable mid-panel.

Referring to FIG. 1, there is shown a pair of shutter panels 10 secured to an exterior surface 12 on a building or structure 14, such as a residential or a commercial building. It will be appreciated immediately, however, that the component shutter panels 10 may be secured to the external surfaces of a wide variety of structures and are thus not limited to residential and commercial dwellings.

The component shutter panels 10 typically are secured on opposite sides of one or more windows 16 of the dwelling 14. Since the window 16 may vary widely in dimensions, and more particularly in overall height, and since it is usually desired to have the component shutter panels 10 match the overall height of the window or windows 16, the component shutter panels 10 must either be made to precise lengths or cut and assembled to form shutters having precise, desired lengths to match the overall height of the window(s) adjacent to which the component shutter panels 10 will be installed. Since the precisely needed length is usually not determined until the overall height of the windows 16 are determined, it has heretofore been necessary to manufacture component shutter assemblies having a rather large plurality of independent component pieces, and including a pair of side rails which are cut to length at the work site or at a factory before assembling the shutter panel to the desired length. Alternatively, if the shutter panel is to be manufactured as a one-piece component, then a molding tool suitable to mold the shutter to the precise, desired length is needed. Either arrangement results in a relatively high number of tools being required to produce shutter panels having widely varying lengths. Additionally, the assembly of a large plurality of component parts at the work site often requires additional man power and can slow down the construction process if a large number of shutters are to be secured to a structure such as an apartment complex.

The component shutter panels 10 of the present invention overcome these drawbacks by generally providing a small plurality of standard length, one-piece molded plastic shutter panels which may be cut to precisely desired lengths to form custom-sized shutters. In the preferred embodiment the standard length, one-piece molded plastic shutter panels are formed in three specific lengths, for example 40 inch, 60 inch and 80 inch lengths. It will be appreciated, however, that other lengths may be selected, as well as a greater or lesser number of standard lengths if desired.

With reference to FIG. 2, an elongated, one-piece molded plastic shutter panel 18 is illustrated. The shutter panel 18, as mentioned above, may be provided in one of a number of standard lengths and, merely as an example, in a length of 60 inches. The shutter panel 18 includes a pair of elongated side rails 20 which are spaced apart from one another and separated by an integrally formed, raised main or center panel 22. The center panel 22 may optionally include a decorative, integrally formed mid-panel section 24. Initially, each end of the shutter panel 18 is preferably formed with a straight edge 26 as indicated at end 18*b*.

With further reference to FIG. 2, when the precise, desired length of the shutter which will be needed is determined, then the length of standard shutter closest to the desired length is selected. For example, if the desired length of shutter is 58 inches, then the 60 inch shutter panel 18 would be selected. One end, for example, end 18*a*, would then be die-cut using a conventional die-cutting tool, router or saw to form an edge 28 which will allow an end panel 30 to be secured thereto to form a finished-appearing raised panel. The end panel 30 has ear portions 30*a* and 30*b*, a panel section 32 and flanges integrally formed 34*a*, 34*b* and 34*c*. The ear portions 30*a* and 30*b* fit within generally U-shaped channels 20*a* and 20*b* of the side rails 20 and the flanges 34*a*–34*c* fit behind the die-cut edge 28 of the center panel 22.

With brief reference to FIG. 4, the end panel 30 is shown secured to the die-cut edge 28 of the shutter panel 18. The ears 30*a* and 30*b* fit within the U-shaped channels 20*a* and 20*b*, respectively, and the flanges 34*a*–34*c* rest on top of the die-cut edge 28 of the center panel 22. The end panel 30 may be ultrasonically welded to the shutter panel 18 at the positions denoted with an "X". Alternatively, threaded fasteners may be used, as well as adhesives.

With further reference to FIG. 2, when the end panel 30 is secured to the shutter panel 18, the first end 18*a* takes the appearance of a finished raised panel. Put differently, the end panel 30 cannot be readily visually detected to be a separate component, but rather appears to be an integrally formed portion of the shutter panel. At this point, end 18*b* of the shutter panel can be die-cut to form an edge identical to die-cut edge 28, and a second end panel 30 can be secured to the second end 18*b* of the shutter panel 18. End 18*b* then takes the appearance of a finished, integrally formed raised panel. The completely assembled shutter thus appears as a component shutter 10 in FIG. 1.

The component shutter assembly 10 thus requires far fewer molding tools to produce the individual component pieces thereof. Since identical end panels 30 are used at the opposite ends of the shutter panel 18, in the embodiment shown in FIG. 2 only two molding tools are needed: one to produce the shutter panel 18 and one to produce the end panel 30. The two molding tools can thus produce the raw component parts necessary to form any length of shutter which is equal to or less than 60 inches. If the shutter panel 18 is formed with an 80 inch length, then a component shutter panel having any desired length up to and including 80 inches could be formed therefrom. If the shutter panel 18 has a length of 40 inches, then a component shutter assembly could be formed therefrom having any desired length which is equal to or less than about 40 inches.

Referring now to FIG. 3, there is shown an elongated, plastic, one-piece shutter panel 36 in accordance with an alternative preferred embodiment of the present invention. The shutter panel 36 is identical to the shutter panel 18 with the exception that the panel 36 includes an integrally formed end panel portion 38. Accordingly, only one-end of panel 36 is available to be cut to reduce its overall length to a desired length. Since only one end can be cut, a finished shutter panel can be assembled even more quickly from panel 36 than from panel 18. However, if it is desired to have the mid panel section 24 (FIG. 2) at the approximate center of the overall length of the shutter panel 36, then it will be necessary to use the shutter panel 18 which allows both ends to be cut to shorten the shutter panel 18 to the desired length. In FIG. 3, it will be appreciated that an end panel identical to end panel 30 will be secured to an end 36*a* of the panel 36 after a router cut or die cut, such as cut 28 shown in FIG. 2, is made to end 36*a*. The end panel 30 is assembled to end 36*a* after the cut is made in a manner identical to that shown in FIG. 4.

Referring now to FIG. 5, there is shown a louvered, one-piece, molded plastic shutter panel 40 in accordance with another alternative preferred embodiment of the present invention. Shutter panel 40 is substantially identical in construction to shutter panel 18 and includes a pair of U-shaped, elongated side rails 42 and a pair of louvered center panel sections 44 separated by an integrally formed mid-panel section 46. Also shown is an end panel 48 which may be fixedly secured to an end 40*b* of the shutter panel 40. The shutter panel 40 is provided in a small plurality of standard lengths just as is shutter panel 18. At the present time such lengths are contemplated to be about 40 inches, 60 inches and 80 inches. Again, however, a greater or lesser plurality of standard lengths of shutter panels could be provided. Also, the standard lengths could be varied, for example, to 30, 70, and 100 inches.

With further reference to FIG. 5, end 40*a* and end 40*b* of the shutter panel 40 may be cut as needed to reduce the overall length of the shutter panel 40 to the desired length. End panel 48 may then be secured to end 40*b* and another end panel 48 secured to end 40*a* in the same manner. The end panel 48 is shown secured to the shutter panel 40 in FIG. 7. The end panel 48 includes ear portions 48*a* and 48*b* and a front panel section 48*c*. The front panel section 48*c* fits over a small plurality of individual louvers 40*a* of the shutter panel 40 and the ear portions 48*a* and 48*b* fit within channels 42*a* and 42*b* of the side rails 42. Ultrasonic welds may be placed at the areas indicated by an "X" to fixedly secure the end panel 48 to the shutter panel 40. When fully assembled, the component shutter assembly 40 has the appearance of two integrally formed end panels, one at each end 40*a* and 40*b*, and has a specific, desired length which is approximately equal to or less than the standard length of the shutter panel 40 before cutting.

Referring now to FIG. 6, a louvered shutter panel 50 in accordance with an alternative preferred embodiment of the present invention is shown. Louvered shutter panel 50 is substantially identical in construction to shutter panel 40 with the exception that louvered shutter panel 50 includes an integrally formed end panel 52. Accordingly, only end 50*a* of panel 50 needs to be cut to shorten the panel 50 to a specific, desired length. Thus, louvered shutter panel 50 may be constructed even more quickly into a completed component shutter assembly than louvered shutter panel 40. However, if it is desired to have mid panel section 54 at the precise mid-point of the overall length of the shutter panel 50, then it will be necessary to cut both ends as described in connection with the assembly of louvered shutter panel 40 in FIG. 5. Louvered shutter panel 50 may also be supplied in a number of standard lengths such as 40 inches, 60 inches and 80 inches or, alternatively, in a plurality of other standard lengths.

Referring now to FIG. 8, another louvered component shutter panel 56 is shown in accordance with another alternative preferred embodiment of the present invention. Louvered shutter panel 56 comprises a one-piece, integrally formed plastic shutter panel 57 having a pair of U-shaped side rails 58 and a plurality of louvers 59 integrally formed inbetween the side rails 58. It will be noted immediately that shutter panel 56 does not include a mid panel section such as shutter panels 40 and 50 of FIGS. 5 and 6, respectively. However, a removable center or midpanel section 60 is provided which may be releasably secured without any external tools to the louvers 59 at any point along the length of the shutter panel 57. Thus, if for decorative or aesthetic purposes one does not wish to have the center panel section 60 at precisely the mid point of the overall length of the shutter panel 56, then the center panel 60 could be placed either closer to a first end 57*a* or a second end 57*b* of the shutter panel 57. This allows even more aesthetic creativity and a further degree of "customizing" of the component shutter panel 56.

Figure 9:
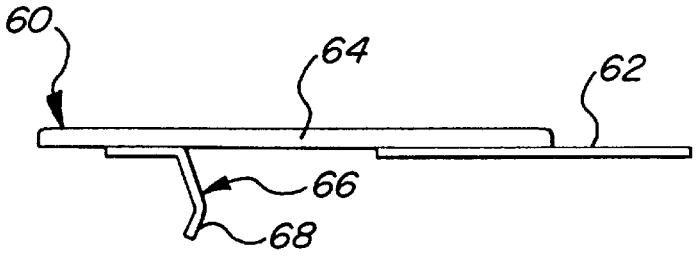
FIG. 9 is a side view of the removable mid-panel illustrated in FIG. 8.

Referring to FIG. 9, the removable mid-panel 60 includes a planar lip portion 62, a face panel portion 64 and a lower flange portion 66. The planar lip portion 62 and lower flange portion 66 may be integrally formed with the face panel portion 64 or, alternatively, may be secured to the face panel portion 64 by ultrasonic welding, adhesives, etc.

Figure 11:
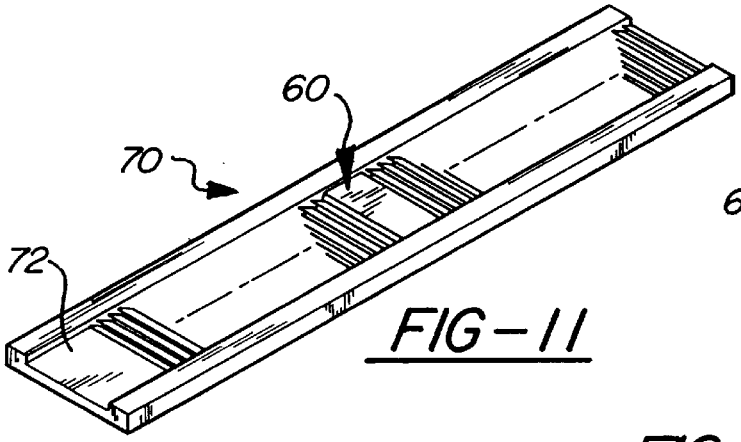
FIG. 11 is a perspective view of a louvered shutter panel having an integrally formed end panel and incorporating the removable mid-panel shown in FIGS. 8–10.
Figure 10:
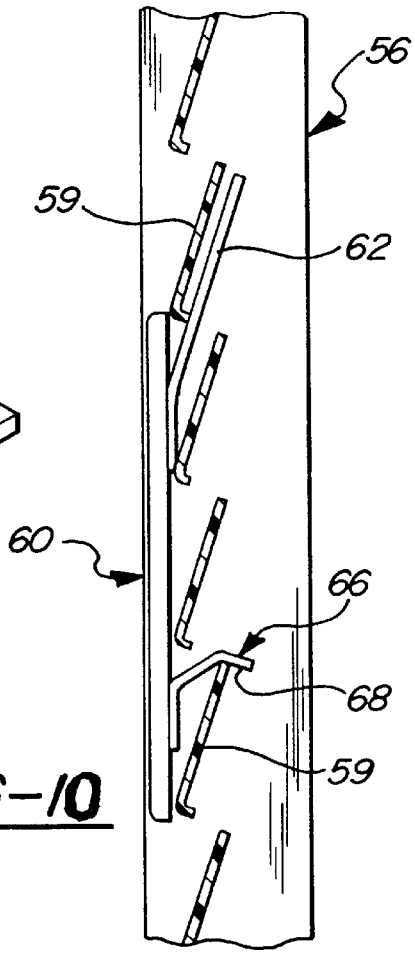
FIG. 10 is a cross sectional view of a portion of the louvered shutter panel showing the independent mid-panel releasably secured thereto.

Referring to FIG. 10, the removable mid-panel 60 is shown secured to the louvered panel section 56. The removable mid-panel 60 is installed by sliding the planar lip portion 62 under one of the louvers 59 and urging the lower flange portion 66 over a different one of the louvers 59 until the mid-panel 60 snaps into the engagement shown in FIG. 10. In this regard it will be noted that lip 68 of the lower flange portion 66, being angled slightly, prevents the mid-panel 60 from simply sliding off the louvers 59. It will also be appreciated that the removable mid-panel 60 could just as easily be installed on the shutter panels 40 and 50 of FIGS. 5 and 6, respectively, if it is desired, for aesthetic purposes, to have more than one midpanel. FIG. 11 shows a louvered shutter 70 incorporating an integrally formed end panel 72 and the removable mid-panel 60.

It will be appreciated then that the various embodiments of the present invention disclosed herein permit essentially custom-sized shutters to be created from only a very small plurality of standard length component pieces. In each of the embodiments shown in FIGS. 2 and 3, custom-sized component shutter assemblies can be formed from only two independent parts: a shutter panel and an end panel. The assembly of the component shutter assemblies disclosed herein is also simplified significantly as much fewer independent component parts are required to be assembled to form a finished shutter assembly. Thus, the component shutter assemblies disclosed herein can be manufactured at significantly lower costs than previously developed component shutters which require manufacture and assembly of a wide number of component pieces.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method of forming a shutter assembly, said method comprising the steps of:

forming a one-piece, integrally formed shutter panel having a length and a pair of spaced apart side sections;

forming a center panel on the shutter panel that extends between the side sections;

providing a raised panel portion on the center panel that is positioned between and spaced from the side sections;

providing angled wall portions on the center panel adjacent the raised panel portion and sloping downwardly therefrom toward the side sections;

cutting a first end of the center panel along a lateral cut line that extends at least partially across the center panel;

forming the lateral cut line to include a plurality of segments wherein at least two of the segments are non-parallel;

cutting the shutter panel along a first longitudinal cut line that extends from one end of the lateral cut line adjacent one of the side sections to a first end of the shutter panel;

cutting the shutter panel along a second longitudinal cut line that extends from another end of the lateral cut line adjacent another one of the side sections to the first end of the shutter panel;

whereby the cut lines define a cut-out region in the shutter panel that includes sides adjacent the side sections and an end bounded by the center panel wherein the longitudinal cut lines and the lateral cut line do not intersect the side sections; and securing an end panel to the shutter panel within the cut-out region.

2. A method of forming a shutter assembly, said method comprising the steps of:

forming a one-piece, integrally formed shutter panel having a length and a pair of spaced apart side sections;

forming a center panel on the shutter panel that extends between the side sections;

providing a raised panel portion on the center panel that is positioned between and spaced from the side sections;

providing angled wall portions on the center panel adjacent the raised panel portion and sloping downwardly therefrom toward the side sections;

cutting a first end of the center panel along a lateral cut line that extends at least partially across the center panel, wherein the lateral cut line includes a first segment that is perpendicular to the side sections and extends across the raised panel portion, wherein the lateral cut line includes a second segment that extends from one end of the first segment across one of the angled wall portions at an angle relative to the side sections, and wherein the lateral cut line includes a third segment that extends from another end of the first segment across another one of the angled wall portions at an angle relative to the side sections;

forming the lateral cut line to include a plurality of segments wherein at least two of the segments are non-parallel;

cutting the shutter panel along a first longitudinal cut line that extends from one end of the lateral cut line adjacent one of the side sections to a first end of the shutter panel;

cutting the shutter panel along a second longitudinal cut line that extends from another end of the lateral cut line adjacent another one of the side sections to the first end of the shutter panel;

whereby the cut lines define a cut-out region in the shutter panel that includes sides adjacent the side sections and an end bounded by the center panel portion wherein the longitudinal cut lines and the lateral cut line do not intersect the side sections; and securing an end panel to the shutter panel within the cut-out region.

* * * * *